US007641519B1

(12) United States Patent
Chen

(10) Patent No.: US 7,641,519 B1
(45) Date of Patent: Jan. 5, 2010

(54) USB CONNECTOR

(75) Inventor: Po-Jung Chen, Taoyuan (TW)

(73) Assignee: U.D. Electronic Corp., Taoyuan County (TW)

( * ) Notice: Subject to any disclaimer, the term of this patent is extended or adjusted under 35 U.S.C. 154(b) by 0 days.

(21) Appl. No.: 12/406,132

(22) Filed: Mar. 18, 2009

(51) Int. Cl.
*H01R 24/00* (2006.01)

(52) U.S. Cl. ..... 439/660; 439/607.54

(58) Field of Classification Search ..... 439/660, 439/676, 607.4, 607.54
See application file for complete search history.

(56) References Cited

U.S. PATENT DOCUMENTS 7,517,253 B1 * 4/2009 Chiang ..... 439/660

2009/0111330 A1 * 4/2009 Lin et al. ..... 439/638

* cited by examiner

*Primary Examiner*—Neil Abrams

(57) ABSTRACT

A USB connector includes an electrically insulative housing, which has an exposed space area defined in the bottom wall of a tongue plate at the front side of an upper base member thereof and terminal grooves formed in the bottom wall of the tongue plate, first metal terminals embedded in the upper base member and the tongue plate each having a contact end positioned in a respective locating groove in the exposed space area and a bonding end extended out of the upper base member for bonding, and second metal terminals each having a base portion respectively upwardly forced into the terminal grooves in direction perpendicular to the insertion direction of a matching plug and a front contact end suspending outside the terminal grooves and a rear bonding end extended out of the rear side of the upper base member for bonding.

8 Claims, 8 Drawing Sheets

USB CONNECTOR

BACKGROUND OF THE INVENTION

1. Field of the Invention

The present invention relates to electric connectors and more particularly, to a USB (Universal Serial Bus) connector, which comprises an electrically insulative housing, a set of first metal terminals integrally embedded in an upper base member and tongue plate of the electrically insulative housing, and a set of second metal terminals set in terminal grooves in the tongue plate and upper base member of the electrically insulative housing in a direction perpendicular to the insertion direction of a matching plug. The mounting design of the second metal terminals facilitates their installation in the electrically insulative housing by an automatic machine.

2. Description of the Related Art

Following fast development of modern technology, advanced consumer electronic products, such as cell phones, digital cameras, notebook computers, digital video cameras, MP3 players, PDAs, and etc., have been continuously created and are intensively used in our daily living for different applications. These advanced electronic products may use a transmission cable for transmitting photos, files, programs and other data. For the transmission of data, data transmission speed is quite important. Nowadays, USB (Universal Serial Bus) interfaces are most commonly used in consumer electronic products. USB 1.1 is currently used to power our mice, scanners, printers, MP3 and many other peripherals. USB2.0 is new standard that operates at 480 Mbps, about 40× times faster than USB 1.1 which currently works at just 12 Mbps.

FIG. 8 illustrates a USB2.0 connector according to the prior art. According to this design, the USB2.0 connector comprises an electrically insulative housing A that has defined therein a plurality of terminal slots A1, a metal terminal set including a plurality of metal terminals B respectively positioned in the terminal slots in the electrically insulative housing A, and a metal shielding shell C that surrounds the electrically insulative housing A. The electrically insulative housing A is configured for the insertion of a matching plug. Further, the metal terminals B are installed in the electrically insulative housing A in direction reversed to the insertion direction of a matching plug. This design of USB connector has drawbacks as follows:

1. Because the installation direction of the metal terminals B is reversed to the insertion direction of a matching plug, there is a space limitation during installation of the metal terminals B in the electrically insulative housing A. This design of USB connector does not facilitate installation of an extra metal terminal set in the electrically insulative housing A with an automatic machine to constitute a USB3.0 format.

2. Once an extra metal terminal set is added to the USB connector, the two sets set of metal terminal metal terminal set may interfere with each other during signal transmission.

Therefore, it is desirable to provide a USB connector that eliminates the aforesaid drawbacks.

SUMMARY OF THE INVENTION

The present invention has been accomplished under the circumstances in view. It is one object of the present invention to provide a USB connector, which facilitates installation of metal terminals in direction perpendicular to the insertion direction of a matching plug. It is another object of the present invention to provide a USB connector, which facilitates automatic fabrication.

To achieve these and other objects of the present invention, a USB connector comprises an electrically insulative housing, a set of first metal terminals, and a set of second metal terminals. The electrically insulative housing comprises upper base member and a tongue plate forwardly extended from the front side of the upper base member. The tongue plate comprises an exposed space area defined in the front side of the bottom wall thereof remote from the upper base member, and a plurality of terminal grooves formed in the bottom wall at a rear side relative to the exposed space area. The first metal terminals are embedded in the upper base member and tongue plate of the electrically insulative housing, each comprising a front contact end suspending in the exposed space area of the tongue plate and a rear bonding end extended out of the rear side of the upper base member for bonding to an external circuit board. The second metal terminals are respectively upwardly inserted into the terminal grooves of the tongue plate, each comprising a base portion positioned in one terminal groove of the tongue plate, a front contact end extended from the front side of the base portion and exposed outside the associating terminal groove, and a rear bonding end extended from the rear side of the base portion for bonding to the external circuit board. Because the mounting direction of the second metal terminals is perpendicular to the insertion direction of the matching plug, the invention facilitates installation of the second metal terminals in the electrically insulative housing by an automatic machine.

Further, the first metal terminals are integrally embedded in the tongue plate and upper base member of the electrically insulative housing and electrically isolated from the second metal terminals by the electrically insulative material of the electrically insulative housing, assuring excellent signal transmission and avoiding signal transmission interference.

Further, the tongue plate extends forwardly from the upper base member, having a beveled guide edge disposed remote from the upper base member for guiding the matching plug smoothly into position.

DETAILED DESCRIPTION OF THE PREFERRED EMBODIMENT

Figure 1:
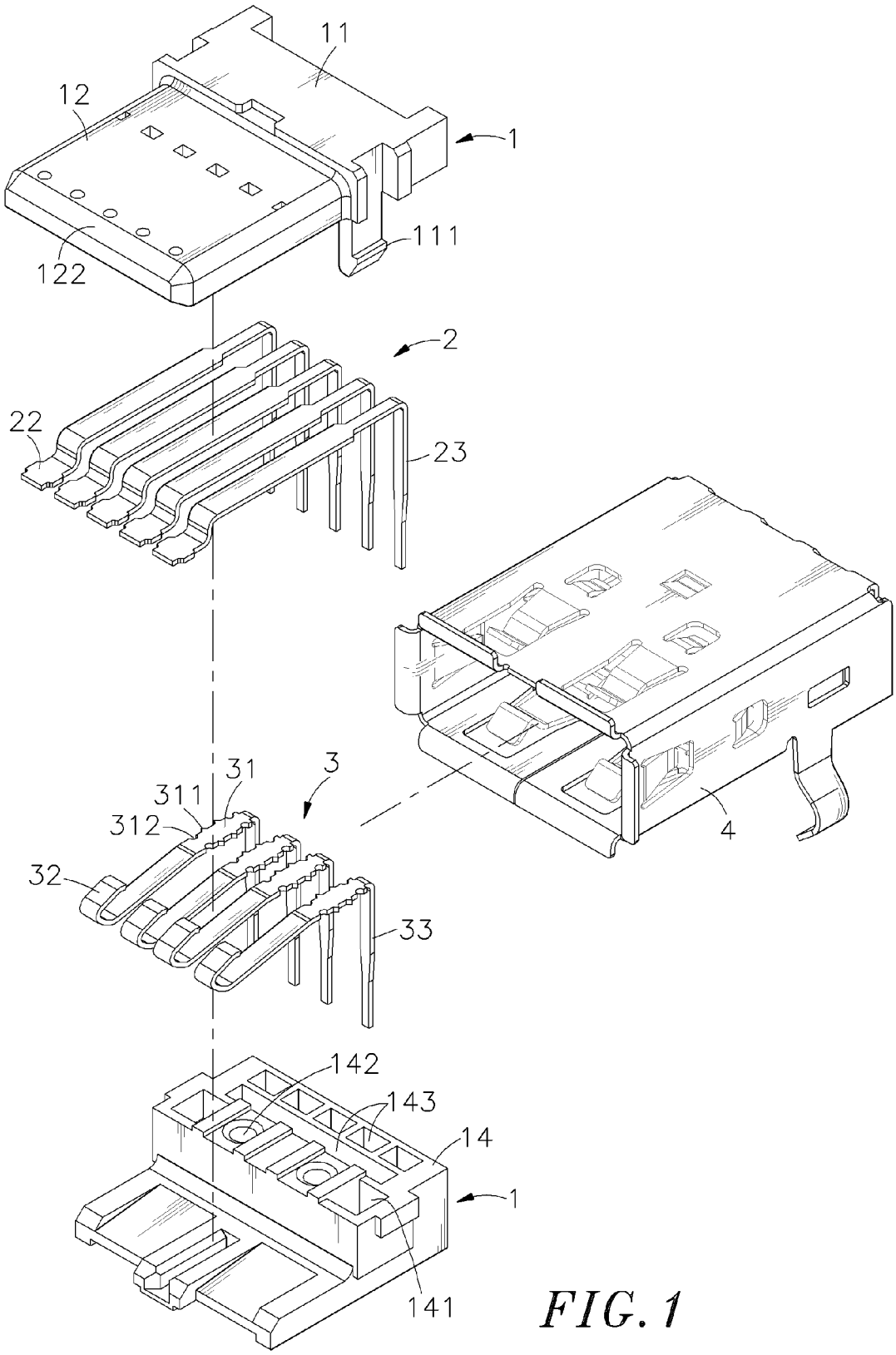
FIG. 1 is an exploded view of a USB connector in accordance with the present invention.
Figure 2:
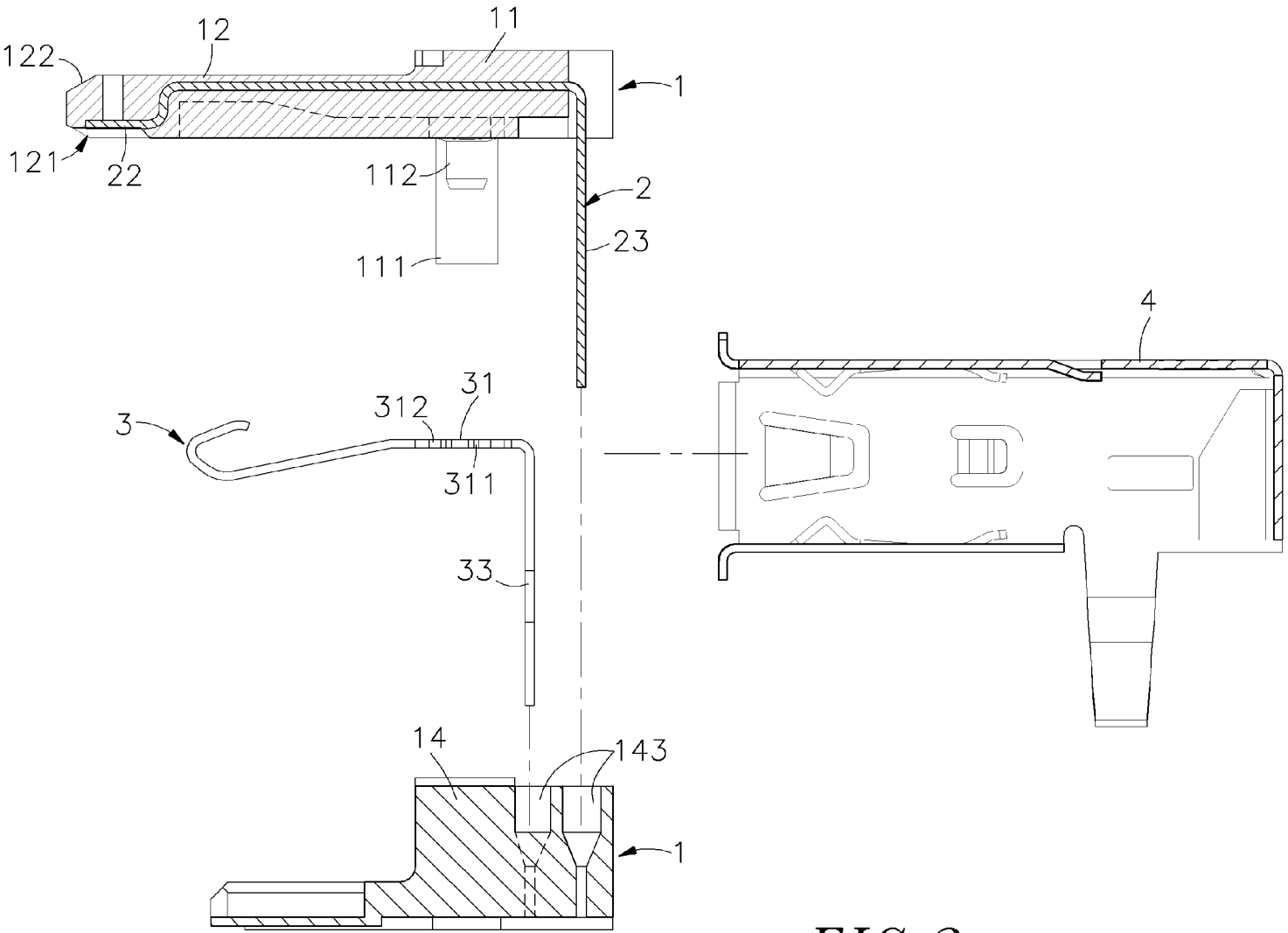
FIG. 2 is an exploded sectional side view of the USB connector in accordance with the present invention.
Figure 3:
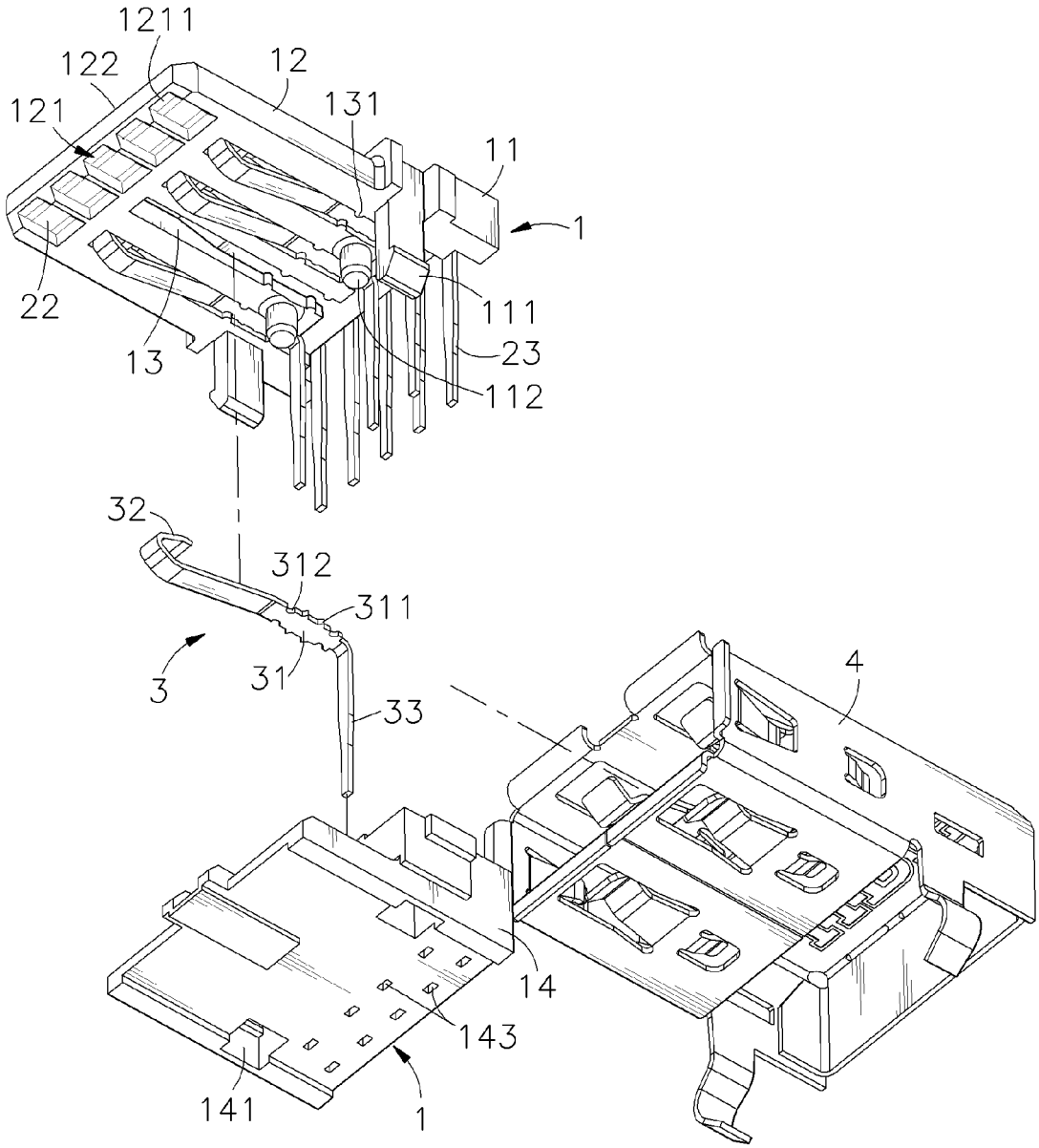
FIG. 3 is another exploded view of the USB connector in accordance with the present invention.

Referring to FIGS. 1~3, a USB connector in accordance with the present invention is a USB socket comprising an electrically insulative housing 1, a set of first metal terminals 2, a set of second metal terminals 3, and a metal shielding shell 4.

The electrically insulative housing 1 comprises an upper base member 11, a tongue plate 12, and a bottom base member 14. The upper base member 11 comprises two bottom hooks 111 respectively downwardly extended from two opposite lateral sidewalls thereof, and a plurality of bottom locating rods 112 respectively downwardly extended from the bottom wall thereof and spaced between the two bottom hooks 111. The tongue plate 12 is formed integral with and extends forwardly from the front side of the upper base member 11, comprising an exposed space area 121 defined in the front side of the bottom wall thereof remote from the upper base member 11, a plurality of locating grooves 1211 formed in the bottom wall within the exposed space area 121, a beveled guide edge 122 defined in the front side of the top wall thereof opposite to the exposed spaced area 121, a plurality of terminal grooves 13 formed in the bottom wall and arranged in parallel, and a plurality of protruded portions 131 located on two opposite lateral sides of each of the terminal grooves 13. The bottom base member 14 is fastened to the bottom side of the upper base member 11, comprising two hook holes 141 for engagement with the bottom hooks 111 of the upper base member 11 respectively, a plurality of recessed locating holes 142 for receiving the bottom locating rods 112 of the upper base member 11 respectively, and two transverse rows of terminal slots 143.

The first metal terminals 2 are embedded in the tongue plate 12 and upper base member 11 of the electrically insulative housing 1, each having a contact end 22 and a bonding end 23. The contact ends 22 of the first metal terminals 2 are respectively positioned in the locating grooves 1211 within the exposed space area 121. The bonding ends 23 of the first metal terminals 2 are respectively extended out of the upper base member 11 and inserted through one transverse row of terminal slots 143 of the bottom base member 14 of the electrically insulative housing 1.

The second metal terminals 3 are respectively positioned in the terminal grooves 13 of the electrically insulative housing 1. Each second metal terminal 3 comprises a base portion 31 positioned in one terminal groove 13, a plurality of protrusions 311 protruded from two opposite lateral sides of the base portion 31 and respectively forced into engagement with the two opposite side walls of the associating terminal groove 13, a plurality of retaining grooves 312 respectively located on the two opposite side lateral sides of the base portion 31 and forced into engagement with the protruded portions 131 in the associating terminal groove 13, a contact end 32 forwardly extended from the front side of the base portion 31 and suspending in the bottom wall of the tongue plate 12 behind the front side of the exposed space area 121, and a bonding end 33 extended from the rear side of the base portion 31 through the upper base member 11 of the electrically insulative housing 1 and turned vertically downwards and inserted through one of the other transverse row of terminal slots 143 of the bottom base member 14.

The metal shielding shell 4 is a box-like metal shell that surrounds the electrically insulative housing 1.

Figure 4:
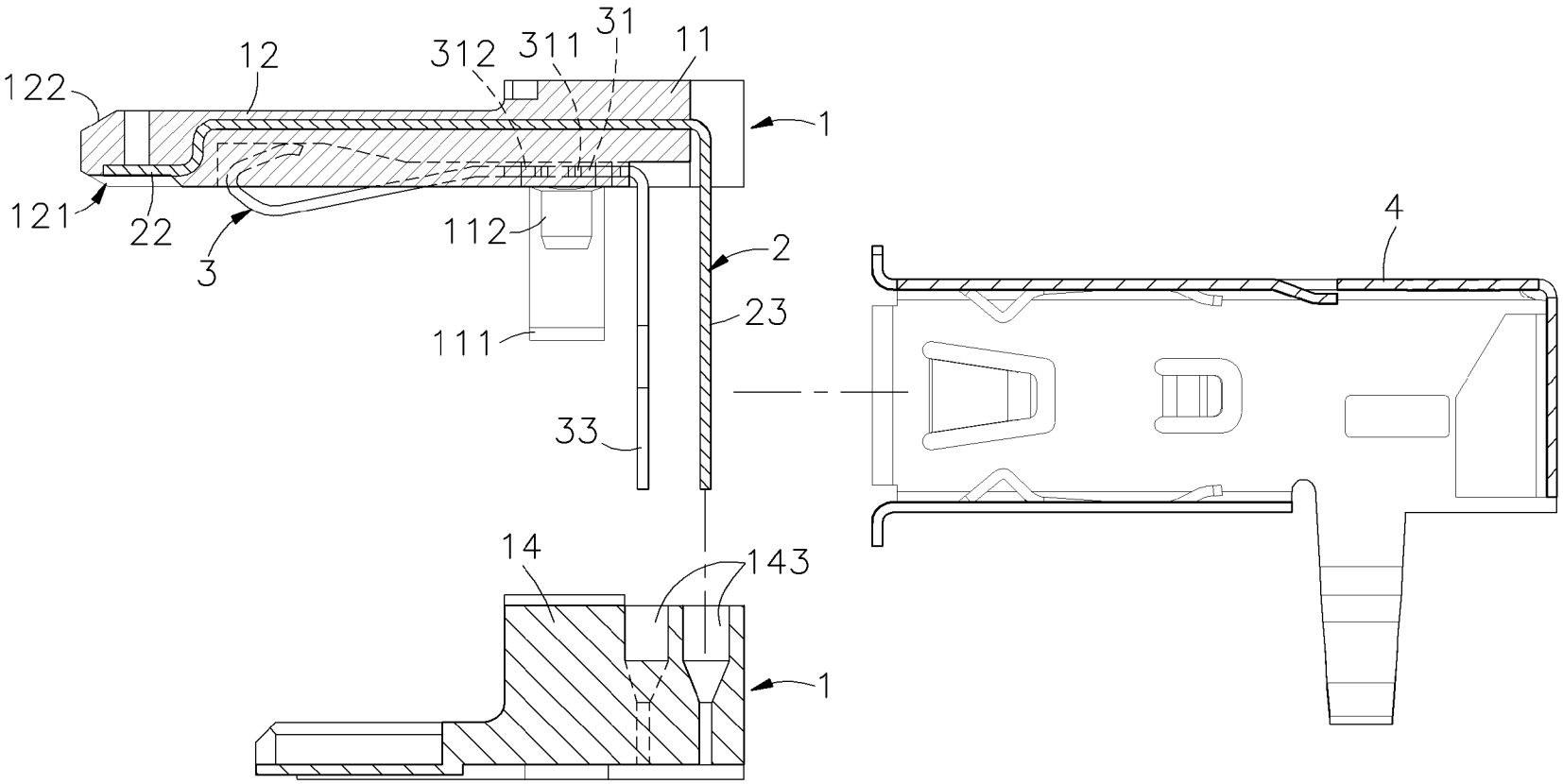
FIG. 4 corresponds to FIG. 3, showing the first metal terminals embedded in the upper base member and tongue plate of the electrically insulative housing and the second metal terminals positioned in the terminal grooves in the tongue plate and extended out of the rear side of the upper base member.

Referring to FIG. 4 and FIG. 2 again, the bonding ends 23 of the first metal terminals 2 are extended out of the rear side of the upper base member 11 of the electrically insulative housing 1 and bent downwards and then inserted through one transverse row of terminal slots 143 of the bottom base member 14 of the electrically insulative housing 1 for bonding to an external circuit board (not shown). The second metal terminals 3 are forced upwards into the terminal grooves 13 in the bottom wall of the tongue plate 12 of the electrically insulative housing 1 in a direction perpendicular to the insertion direction of a matching plug. After insertion of the second metal terminals 3 into the terminal grooves 13, the bonding ends 33 of the second metal terminals 3 are respectively inserted through one transverse row of terminal slots 143 of the bottom base member 14 of the electrically insulative housing 1 for bonding to the same external circuit board.

Figure 5:
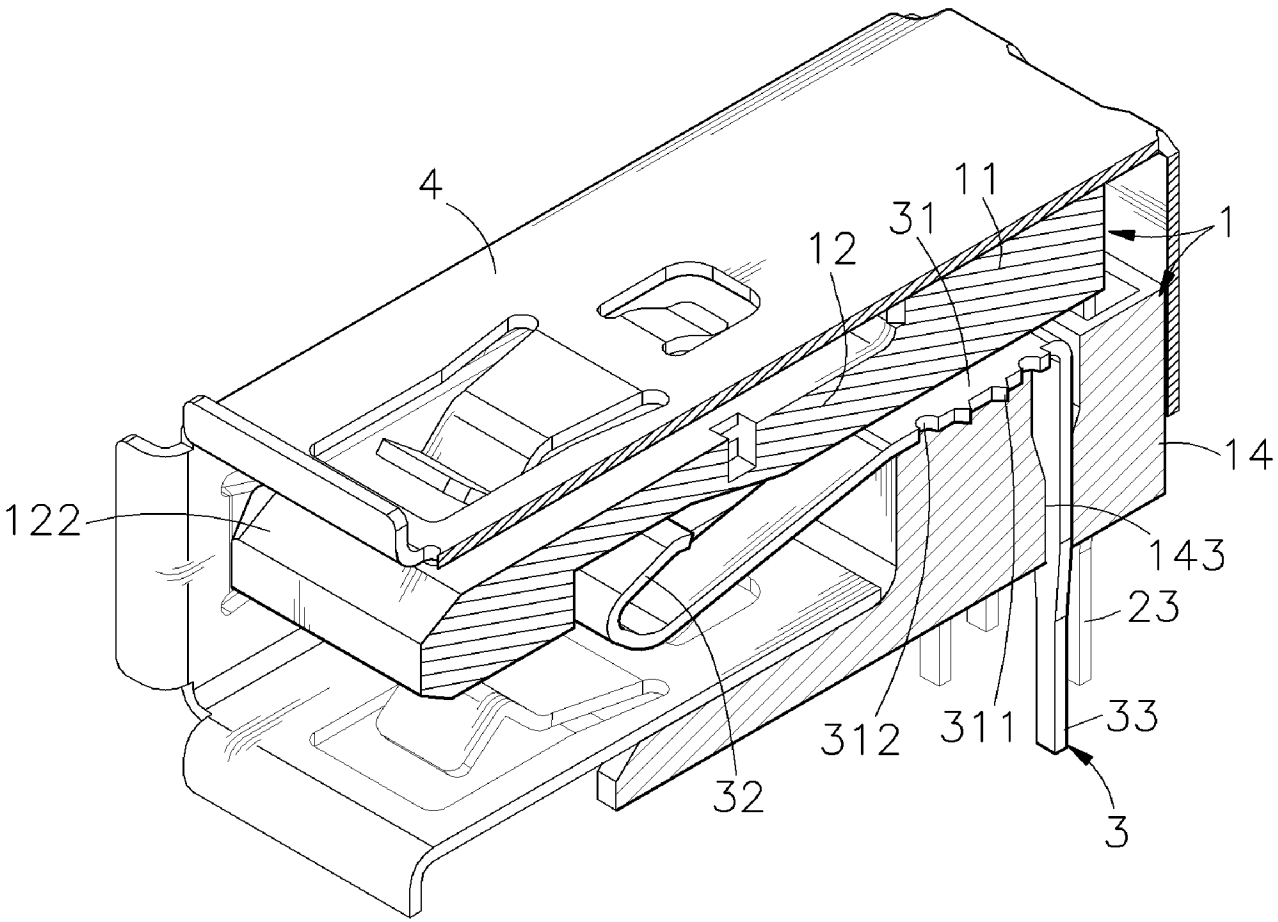
FIG. 5 is a sectional elevation of the USB connector in accordance with the present invention, showing the positioning of one second metal terminal in the associating terminal groove.
Figure 6:
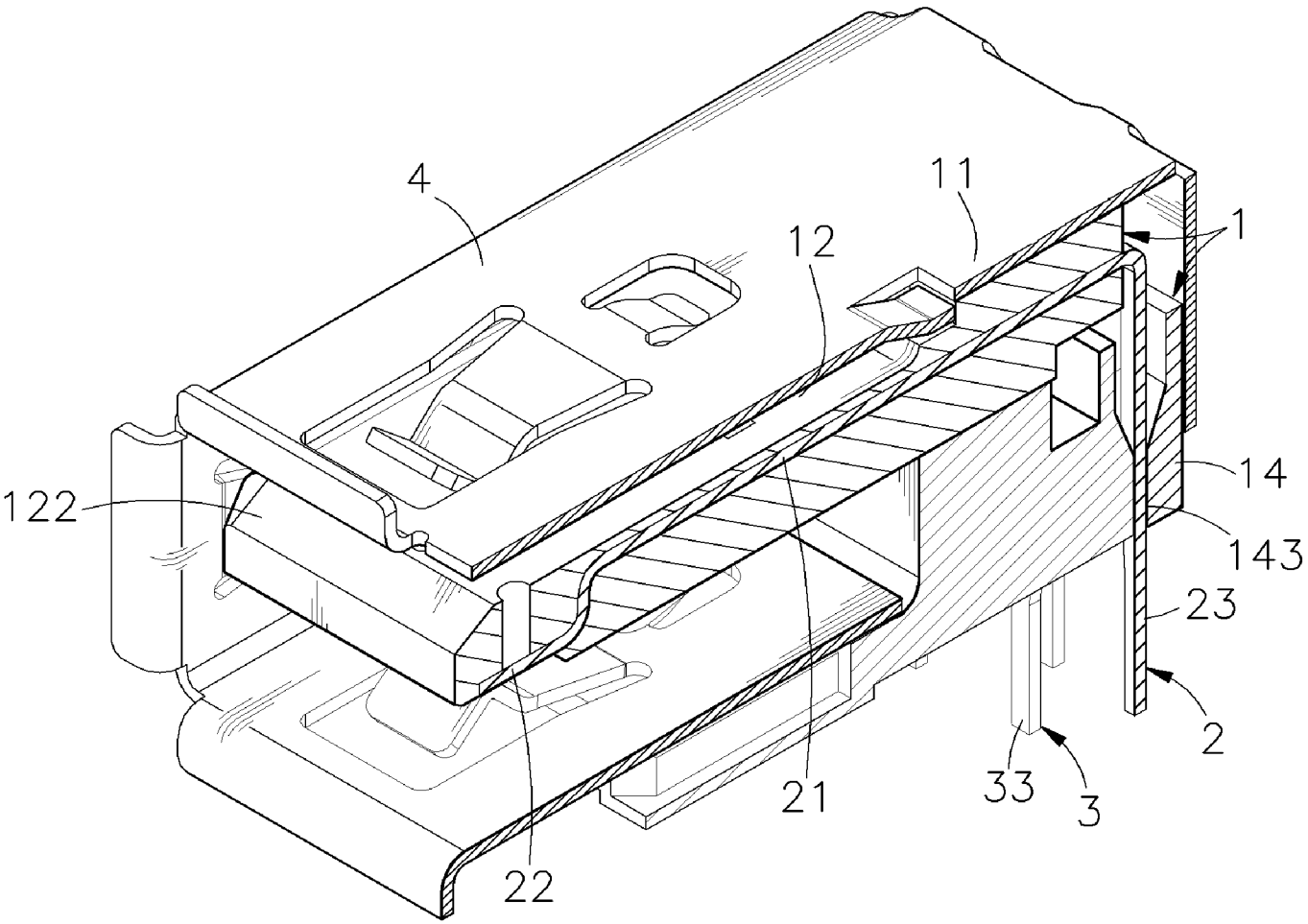
FIG. 6 is another sectional elevation of the USB connector in accordance with the present invention, showing the positioning of one first metal terminal in the tongue plate.
Figure 7:
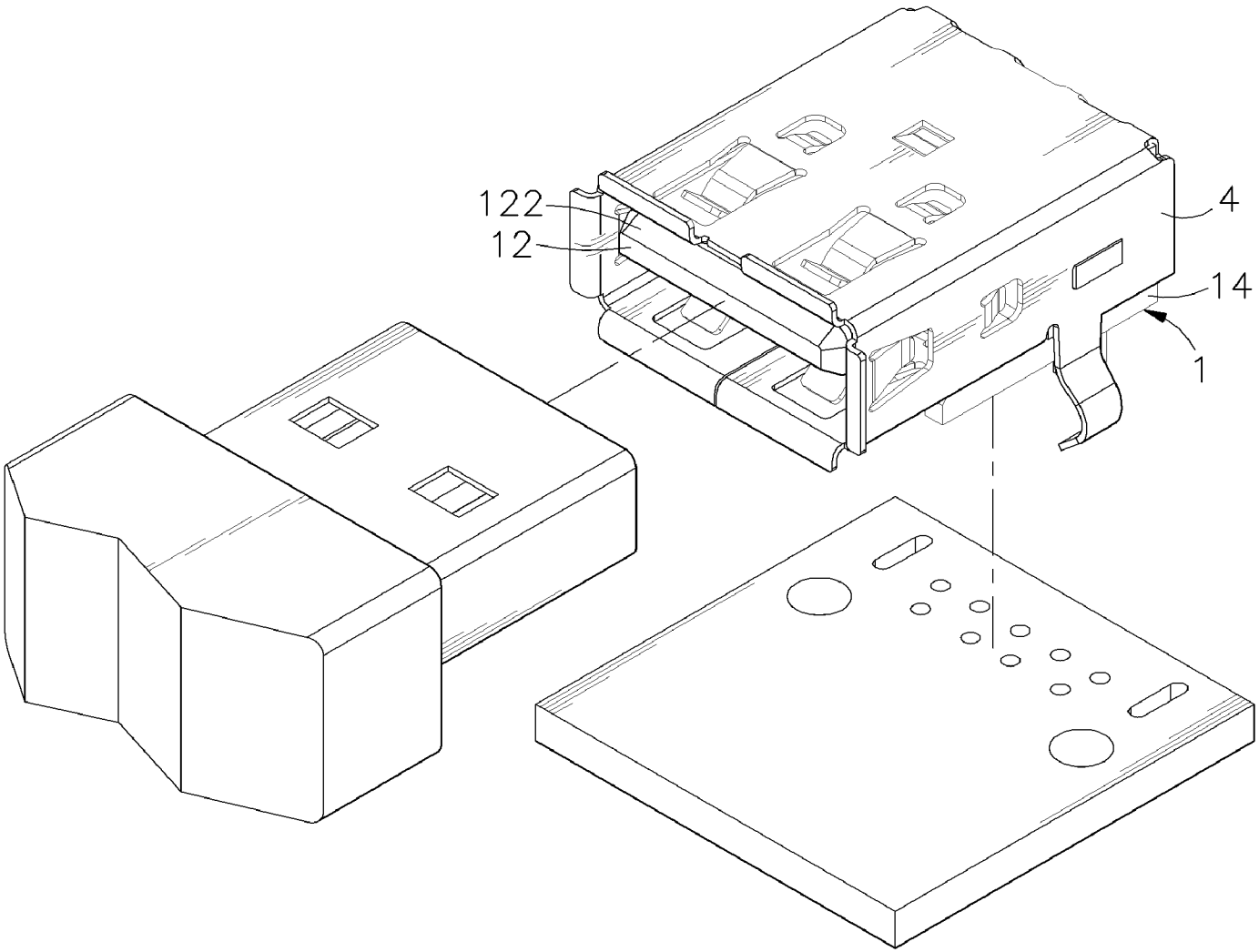
FIG. 7 is an exploded view of the present invention, showing the relationship between the USB connector, a matching plug and a circuit board.
Figure 8:
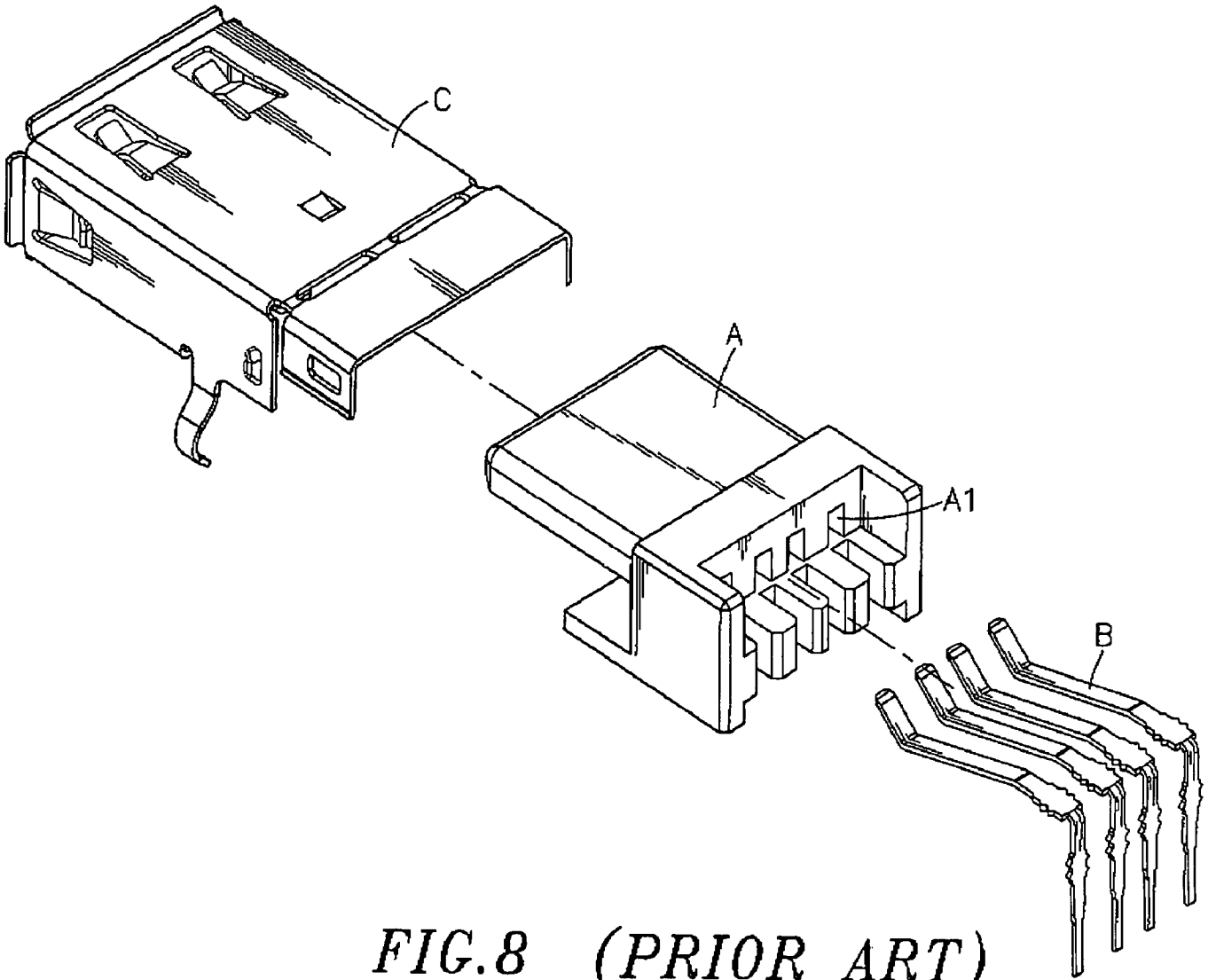
FIG.8 (PRIOR ART)
FIG. 8 is an exploded view of a USB connector according to the prior art.

Referring to FIGS. 5~7, the contact ends 32 of the second metal terminals 3 have a curved shape and are partially exposed to the outside of the terminal grooves 13 for the contact of the pins of a matching plug. Further, the first metal terminals 2 are integrally embedded in the tongue plate 12 and upper base member 11 of the electrically insulative housing 1 in such a manner that the contact ends 22 of the first metal terminals 2 are respectively positioned in the locating grooves 1211 within the exposed space area 121. Further, the bonding ends 23 of the first metal terminals 2 and the bonding ends 33 of the second metal terminals 3 are respectively extended out of the upper base member 11 and inserted through the transverse rows of terminal slots 143 of the bottom base member 14 of the electrically insulative housing 1 for bonding to an external circuit board. Further, the beveled guide edge 122 of the tongue plate 12 of the electrically insulative housing 1 facilitates connection of the matching plug.

In conclusion, the invention provides a USB connector, which has the following advantages and features:

1. The mounting direction of the second metal terminals 3 in the terminal grooves 13 in the electrically insulative housing 1 is perpendicular to the insertion direction of the matching plug. This mounting direction design facilitates installation of the second metal terminals 3 in the electrically insulative housing 1 by an automatic machine.

2. The first metal terminals 2 are integrally embedded in the tongue plate 12 and upper base member 11 of the electrically insulative housing 1 and electrically isolated from the second metal terminals 2 by the electrically insulative material of the electrically insulative housing 1, assuring excellent signal transmission and avoiding signal transmission interference.

3. The electrically insulative housing 1 is formed of the upper base member 11, the tongue plate 12 and the bottom base member 14, and the tongue plate 12 extends forwardly from the upper base member 11 and has a beveled guide edge 122 disposed remote from the upper base member 11 for guiding the matching plug smoothly into position.

A prototype of USB connector has been constructed with the features of FIGS. 1~7. The USB connector functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A USB connector comprising an electrically insulative housing, a set of first metal terminals mounted in said electrically insulative housing, a set of second metal terminals mounted in said electrically insulative housing and electrically isolated from said set of first metal terminals, wherein:

said electrically insulative housing comprises upper base member and a tongue plate forwardly extended from a front side of said upper base member, said tongue plate comprising an exposed space area defined in a front side of a bottom wall thereof remote from said upper base member and a plurality of terminal grooves formed in the bottom wall at a rear side relative to said exposed space area;

said first metal terminals are embedded in said upper base member and said tongue plate of said electrically insulative housing, each said first metal terminal comprising a front contact end suspending in said exposed space area of said tongue plate and a rear bonding end extended out of a rear side of said upper base member for bonding to an external circuit board;

said second metal terminals are respectively upwardly inserted into said terminal grooves of said tongue plate, each said second metal terminal comprising a base portion positioned in one said terminal groove of said tongue plate, a front contact end extended from a front side of said base portion and exposed outside the associating terminal groove, and a rear bonding end extended from a rear side of said base portion for bonding to the external circuit board to which said first metal terminals are bonded.

2. The USB connector as claimed in claim 1, wherein each said second metal terminal comprises a plurality of protrusions respectively forced into engagement with two opposite sidewalls of the associating terminal groove.

3. The USB connector as claimed in claim 1, wherein said tongue plate comprises a plurality of protruded portions respectively located on two opposite sides of each of said terminal grooves; each said second metal terminal comprises a plurality of retaining grooves respectively located on two opposite side lateral sides of the base portion thereof and respectively forced into engagement with the protruded portions in the associating terminal groove.

4. The USB connector as claimed in claim 1, wherein said electrically insulative housing further comprises a bottom base member fastened to a bottom side of said upper base member, said bottom base member comprising a plurality of terminal slots for the passing of the bonding ends of said first metal terminals and said second metal terminals.

5. The USB connector as claimed in claim 4, wherein said bottom base member comprises a plurality of hook holes and a plurality of recessed locating holes spaced between said hook holes; said upper base member comprises a plurality of bottom hooks symmetrically disposed at two opposite lateral sides thereof and respectively hooked in said hook holes of said bottom base member, and a plurality of bottom locating rods respectively downwardly extended from a bottom wall thereof and respectively positioned in said recessed locating holes of said bottom base member.

6. The USB connector as claimed in claim 1, further comprising a metal shielding shell surrounding said electrically insulative housing.

7. The USB connector as claimed in claim 1, wherein said tongue plate comprises a plurality of locating grooves formed in said exposed space area; the contact ends of said first metal terminals are respectively extended to the locating grooves in said exposed space area.

8. The USB connector as claimed in claim 1, wherein said tongue plate comprises a beveled guide edge defined in a front side of a top wall thereof opposite to said exposed space area.

* * * * *